US005088670A

United States Patent [19]

Taylor

[11] Patent Number: 5,088,670

[45] Date of Patent: Feb. 18, 1992

[54] CLIP FOR SECURING LENS ELEMENTS IN LIGHT FIXTURES

[76] Inventor: Graham W. Taylor, 1037 Donwood Drive, Victoria, British Columbia, Canada, V8X 4G3

[21] Appl. No.: 571,222

[22] Filed: Aug. 22, 1990

[51] Int. Cl.[5] ..... F21V 17/000

[52] U.S. Cl. ..... 248/225.1; 248/231.8; 362/374

[58] Field of Search ..... 248/225.1, 231.8, 316.7, 248/221.3; 362/374

[56] References Cited

U.S. PATENT DOCUMENTS

| | | | |
|---|---|---|---|
| 774,036 | 11/1904 | Burgess | 211/13 |
| 2,791,681 | 5/1957 | Dunker et al. . | |
| 3,004,147 | 10/1961 | Lessner et al. . | |
| 3,092,336 | 6/1963 | Harling et al. . | |
| 4,014,438 | 3/1977 | O'Toole et al. | 211/13 |
| 4,255,781 | 3/1981 | Plemmons et al. . | |
| 4,898,354 | 2/1990 | Whittington et al. | 248/225.1 |

FOREIGN PATENT DOCUMENTS

| | | | |
|---|---|---|---|
| 630880 | 4/1963 | Belgium | 248/316.7 |
| 2943544 | 10/1979 | Fed. Rep. of Germany . | |

*Primary Examiner*—Alvin C. Chin-Shue

*Attorney, Agent, or Firm*—Beveridge, DeGrandi & Weilacher

[57] ABSTRACT

A retaining clip is shown which is used to secure a lens element within a light fixture during a dislodging event, such as an earthquake or contact with a person or object. This clip protects persons below from injury by the falling lens element or by falling glass, should the lens element or the light bulbs become broken during the event. The clip includes a jaw portion which securely fastens the clip to the light fixture and a tail portion which provides a flattened surface on which the lens rests and a downturned portion to facilitate removal of the clips from the light fixture. The upper jaw and tail portion effectively create an extension of the frame to provide a wider ledge on which the lens may then rest. No tools are required for the installation or removal of the clips, and the clips are easily removed from the light fixtures for replacement of bulbs or for other maintenance.

12 Claims, 2 Drawing Sheets

CLIP FOR SECURING LENS ELEMENTS IN LIGHT FIXTURES

This invention relates to a device for securing and holding a lens within a light fixture during an earthquake or other events which tend to dislodge the lens from the fixture.

BACKGROUND OF THE INVENTION

Conventional fluorescent light fixtures are constructed such that the light fixture is recessed and the lens element is level with the ceiling or ceiling tiles. Conventional light fixtures are provided with a narrow flange on which the lens element rests. Typically, only a few millimeters of the lens overlaps onto the flange, since too large of an overlapping area would hinder removal of the lens when necessary.

Because of this narrow overlapping region, the lenses typically fall to the floor during an earthquake. People may be injured if struck by the falling lenses, or they may be injured if they should slip and fall on the lenses while moving about in the building during and immediately following the earthquake. The inevitable panic during such an event only increases the probability of injury, because of carelessness or the understandable hurry to evacuate the building. The lenses may themselves break during the fall, or the light bulbs may be broken during the event, thus further increasing the chance of injury because of the exposed broken glass and lenses.

Everyday events can also cause the loosely fitting lens elements to become dislodged and fall from the light fixture. While people are playing or working within a building, objects may come into contact with the lenses and dislodge them from the fixture. Workers carrying elongated objects, such as ladders, often accidentally hit a lens, while concentrating on something else. A ball or other object may accidentally hit and dislodge the lens while children are playing indoors. Thus, the dangers from falling lenses can be found in everyday life.

A device is needed which will securely and safely hold the lens elements within their light fixtures during earthquakes or other events which tend to dislodge the lenses from the fixture. The device must be securely fitted to the light, yet easily removable to enable routine maintenance and replacement of light bulbs with a minimum of inconvenience.

SUMMARY OF THE INVENTION

The invention comprises a clip which fastens securely to the light fixture and provides an extension of the longitudinally extending horizontal flange of the light fixture on which the lens element rests. This increases the effective support area of the fixture. The clip includes a jaw portion and an upturned portion which fasten around the horizontal flange and the vertical-wall of the light fixture respectively. A tail portion extends longitudinally from the jaw portion and the horizontal flange and provides an elongated flattened surface on which the lens element rests.

While the clip is securely fastened to the fixture, it may be easily removed by pulling down on the tail portion of the clip and allowing the flange to slip out of a groove defined by the jaw portion of the clip. The upper jaw may be designed with a vertically tapered region to further facilitate removal of the clip. The ease in installation and removal of the clip from the light fixture is important because it makes the device simple and convenient to use, while still being effective. There are no mechanical or moving parts to the clip, thus making it simple to manufacture and requiring no maintenance.

Because of the simple one piece construction, the clips in accordance with the invention may be manufactured by a pressure injection molding process. This process lends itself to mass production; therefore, the clips are relatively inexpensive to manufacture.

In the event of an earthquake or other lens dislodging incident, the clips will remain in place on the fixture. Thus, even if the lens does move upward and breaks the bulbs during the event, or if the bulbs break in another manner, the lens will come back to rest on the clips. Therefore, at least most, if not all of the broken glass will be retained within the light fixture cavity, thus minimizing injuries during the event. In view of the high prevalence of lay-in lenses and recessed fluorescent light fixtures in use throughout the world, the clip of this invention provides an effective and inexpensive means of eliminating unnecessary injury, and reducing potential liability. They can also be of such a size as to be inconspicuous when installed on the fixture without detracting from the usual appearance of the fixture.

BRIEF DESCRIPTION OF THE DRAWINGS

The advantageous features of this invention will be apparent from the following detailed description, taken in conjunction with the accompanying drawings, wherein like reference numbers correspond to the same element throughout the various views in which.

DETAILED DESCRIPTION OF THE INVENTION

The illustrations and dimensions given throughout this specification correspond to the preferred embodiment of the invention. They are intended to be illustrative of the invention and in no way limiting.

Figure 1:
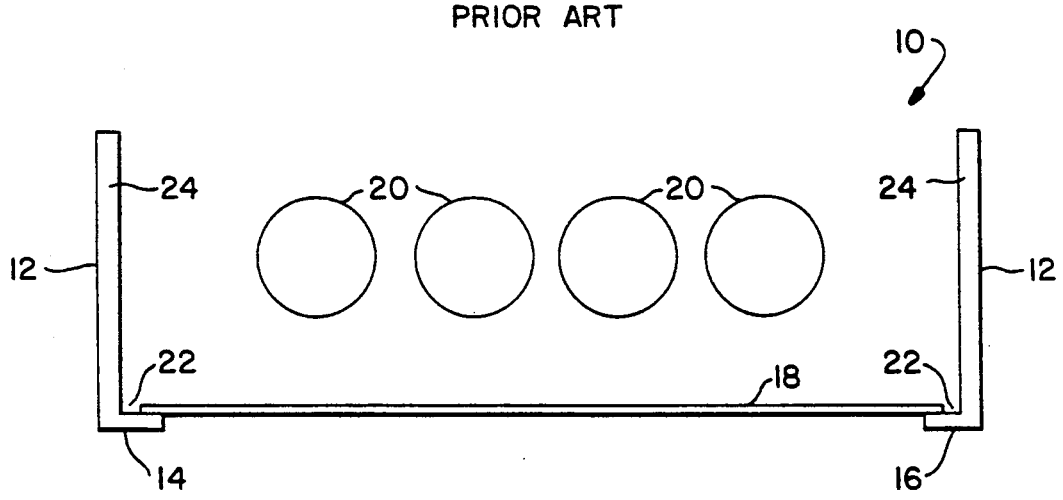
Fig. 1 PRIOR ART
FIG. 1 shows a cross-sectional view of a conventional fluorescent light fixture and lens assembly.

A cross-sectional view of a conventional fluorescent light fixture 10 is shown in FIG. 1. The light fixture 10 is made from a housing or frame 12, which may be constructed of one or more separate pieces. The frame 12 is generally made of metal, such as aluminum, steel, or the like and includes two longitudinally extending horizontal surfaces or ledges 14 and 16, which provide a flattened surface on which the longitudinal edges of the lens element 18 rest (lay in lenses). The lens 18 is typically made from a translucent or transparent plastic material, although glass lenses may be used. The lens 18 generally extends the entire length and width of the light fixture, which for example, may be 18 inches by 48 inches, although a wide variety of lens sizes are available and in use. As shown in FIG. 1, a conventional light fixture 10 contains four separate fluorescent light tubes 20, although a different number of individual fluorescent tubes 20 may be present, depending on the size of the fixture and its intended use. These light fixtures are often recessed so as to be level with the ceiling or ceiling tiles, however, this invention may also apply equally to light fixtures which protrude downwardly from the ceiling.

The portion of the lens 18 which overlaps and rests on the ledges 14 and 16 is very narrow, usually in the range of 5 to 12 mm. To allow for removal of the lens 18, for maintenance or replacement of bulbs 20, there must be some free space (shown at 22) within the fixtures, so that one end of the lens may be removed, thus facilitating the removal of the entire lens 18. Because of the existence of the free space 22, however, the lens element 18 can be easily displaced from the light fixture 10 at times when its removal is not intended, for example, when the entire building is shaken by force of an earthquake, or when a person or object comes into contact with the lens 18. Persons below the fixture are endangered by the falling lens or by shattered plastic or glass, if the lens or fluorescent lamps should break during the event.

Figure 2:
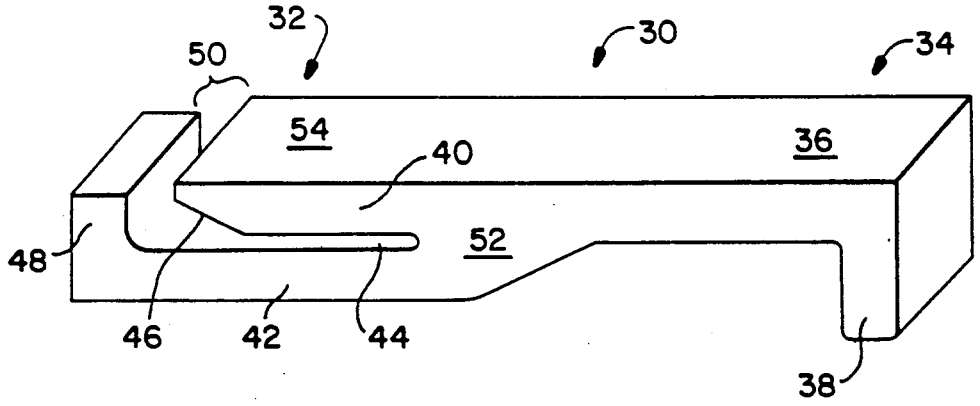
FIG. 2 is a perspective view of the clip in accordance with this invention.

The clip in accordance with this invention is shown generally at 30 in FIG. 2. The clip 30 includes at one end thereof a jaw portion 32 which snaps securely around the frame of the light fixture, and a tail portion 34 at its other end. The tail portion 34 (approximately 2 mm in height its narrowest point) provides a flattened surface 36 on which the lens is placed and supported. A downturned portion 38 (approx. 6 mm high) of the tail portion 34 provides a handle which may be grasped and facilitates the easy removal of the clip 30 from the light fixture. No tools or special equipment is necessary to attach or remove the clips from the light fixture.

The jaw portion 32 of the clip includes an upper jaw 40 spaced above and overlying a portion of a lower jaw 42. The jaws secure the clip to the fixture without the need for attachment by screws, nails, adhesives, or other means. The clip is held in place by the pinching action of the jaws 40, 42 and an upturned portion 48 on the lower jaw 42, wherein the upturned portion 48 is spaced from the end of upper jaw 40 to define an opening 50. The jaws 40 and 42 are joined together at a common location (shown at 52) so as to define a slotted groove 44 into which a horizontal flange surface 14 of the frame of the light fixture 12 is received and fitted. It is preferred that the free end of the upper jaw 40 be tapered in the vertical direction, as shown at 46, with the taper extending downwardly and inwardly from the end of jaw 40 to the lower surface of jaw 40 spaced from the upper surface of jaw 42 and defining the groove 44, so as to allow enough room to easily attach and remove the clip from the fixture.

The upturned portion 48 (approximately 4 mm high) extends upwardly from the lower jaw 42 in the preferred embodiment. The upturned portion 48 enables the clip 30 to be securely fastened to the light fixture, since it presses snugly against a vertical surface 24 (see FIG. 3) of the light fixture. In the preferred embodiment, the top of the upturned portion 48 is approximately 0.5 mm below the flattened upper surface 54 of upper jaw 40.

Figure 3:
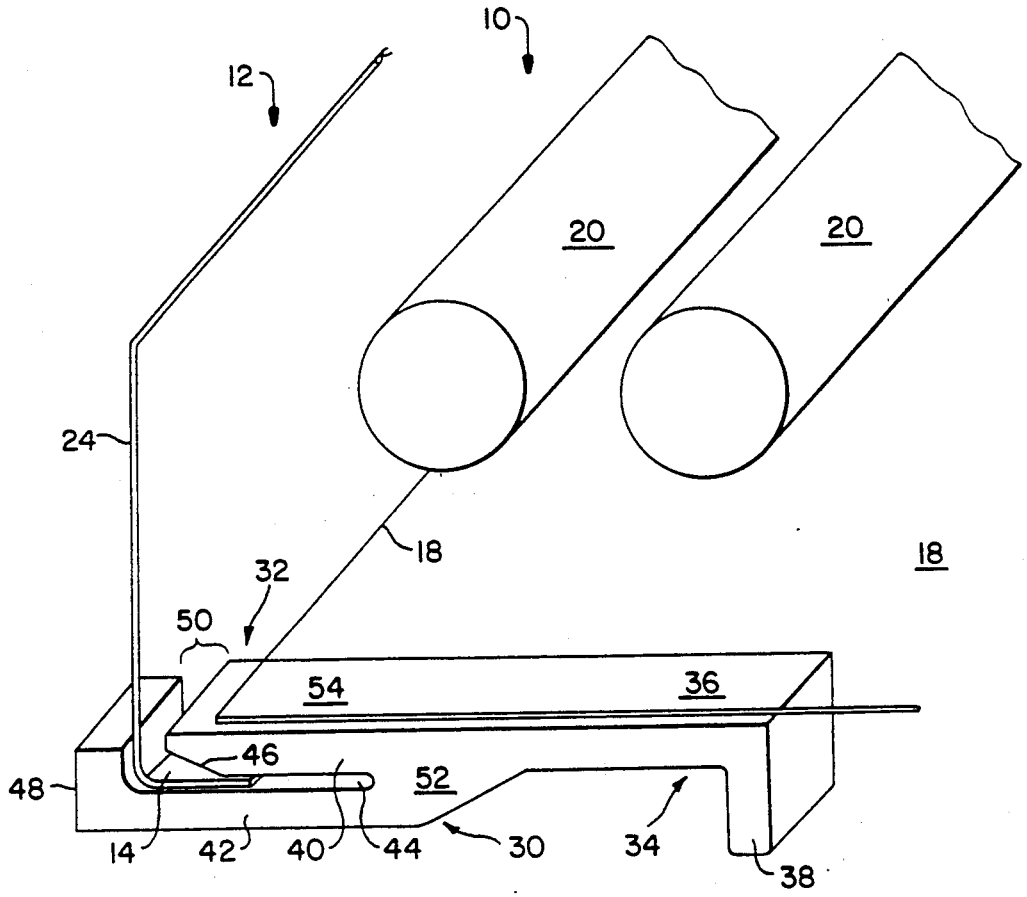
FIG. 3 is a perspective view of the clip in accordance with the invention mounted on a fluorescent light fixture.

FIG. 3 shows the clip 30 in use in accordance with the invention. A portion of the light fixture 10 is shown, including two fluorescent lamps 20 . The clip 30 and ledge 14 sizes are exaggerated to show detail. The upper jaw 40 (approximately 2 mm high) is positioned such that it extends above the horizontal surface of the flange 14 of the frame. The lower jaw 42 (approximately 2 mm high) extends beneath the horizontal surface of the flange 14, such that the flange 14 enters the opening 50 defined by upturned portion 48 and the end of upper jaw 40 and fits into the slotted groove 44 (approximately 0.5 mm high) defined by the upper and lower jaws 40, 42. The lens 18 is shown resting on and supported by the flattened upper surface 54 of jaw 40 and the flattened surface 36 of the tail portion 34. As shown in this figure, the upper jaw 40 includes a flattened surface 54 which coincides and is connected to the flattened surface 36 of the tail portion 34 to provide one smooth, continuous, horizontal, flattened surface on which the lens 18 rests. The tail portion 34 extends longitudinally away from the jaw portion 32 and from the flange 14 in the horizontal direction, so as to effectively provide a horizontal extension of the flange 14.

The upturned portion 48 extends upwardly from the lower jaw 42 and is positioned adjacent to the vertical surface 24 of the frame 12. The upturned portion 48 is designed to fit snugly against the vertical surface 24, thus securely holding the clip in place. The clip will not be dislodged by an earthquake or by moving or shaking the lens 18.

While the clip 30 is securely fastened to the frame 12, FIG. 3 also illustrates the ease in which the clips 30 may be removed from the light fixture, for routine maintenance or replacement of the bulbs 20. By grasping and pulling down on the downturned portion 38 of the tail 34, the clip 30 slides away from the ledge 14 along its tapered portion 46 so that ledge 14 moves out of the groove 44 and the opening 50 as it slides along the vertically tapered portion 46 (tapered approximately 3 mm in the horizontal direction) of the upper jaw 40. In order to facilitate this removal, the clip 30 is preferably made from a stiff but deformable material, such as plastic or polymer materials. Delrin (acetal resin material manufactured by E. I. DuPont, de Nemours & Co.) plastic is advantageously used, since that the material is lightweight, durable, resistant to the heat generated by the lights, and resistant to deterioration by ultraviolet radiation. Such properties are advantageous in the clips used in accordance with the invention.

In the preferred embodiment, the clip is made by conventional pressure injection molding techniques. Such molding techniques are well known and are well suited for mass production of the clip.

Figure 4:
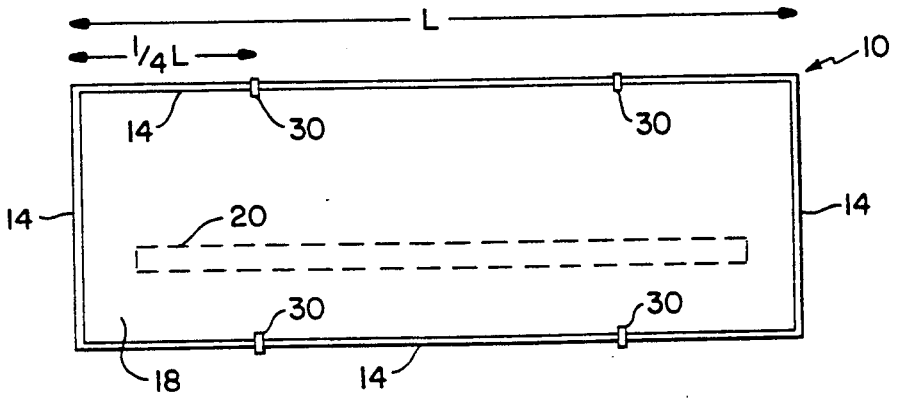
FIG. 4 is a plan bottom view of a recessed light fixture, wherein the lens of the fixture is fully secured by clips in accordance with the invention.

FIG. 4 shows a bottom view of a light fixture 10, with a ledge 14 which extends around the perimeter of the fixture 10 and supports the lens 18 along four sides of the fixture. However, it is only necessary to support the lens by flanges on two opposite sides of the fixture, as shown in FIG. 4. For each lens 18, it is preferred that four clips 30 are used to secure the lens 18 in place. The clips 30 are advantageously located with two clips along each longitudinal edge of the fixture (length L), positioned approximately one-quarter of the long dimension ($\frac{1}{4}$ L) from the lateral edges of the fixture. The clips may be located in other positions, depending upon the preference of the user, as long as they provide support surfaces for the lens in such a manner as to securely retain the lens within the fixture. One fluorescent light tube 20 is shown as broken lines in FIG. 4.

While any number of shapes, sizes and colors of clips may be utilized in accordance with this invention, it is preferred to make the clips of relatively small size and to be colored similar to the color of the light fixture, such that the clips will be relatively unnoticeable. One preferred embodiment of the clip has an overall length of 32 mm, a vertical height of the downturned portion 38 of 6 mm, the vertical height of the upturned portion 48 of 4 mm, and an overall width of 10 mm. The clip produced in this manner has a minimum aesthetic impact.

While the invention has been described in conjunction with particular preferred embodiments, various modifications may be used without departing from the invention as defined in the following claims.

I claim:

1. A clip for securing a lens within a light fixture comprising:

a jaw portion which securely fastens said clip to a frame of said light fixture;

a tail portion longitudinally extending from said jaw portion and away from said frame in the horizontal direction, wherein said tail portion includes a flattened surface onto which said lens is freely laid and a downturned portion to facilitate removal of the clip from the light fixture.

2. A clip as described in claim 1, wherein said jaw portion includes a slotted groove into which a horizontal surface of the frame is fitted.

3. A clip as described in claim 1, wherein said jaw portion includes an upper jaw which extends above a horizontal surface of the frame, and a lower jaw which extends beneath said horizontal surface of the frame.

4. A clip as described in claim 3, wherein an upturned portion is connected to said lower jaw, said upturned portion being located adjacent to a vertical surface of the frame.

5. A clip as described in claim 3, wherein a slotted groove is defined between the upper jaw and the lower jaw.

6. A clip as described in claim 3, wherein the upper jaw includes a free end, said free end being tapered in the vertical direction.

7. A clip as described in claim 3, wherein said upper jaw and said lower jaw are joined together.

8. A clip as described in claim 1, wherein said clip is of a single piece construction.

9. A clip as described in claim 1, wherein said clip is manufactured from a plastic or polymer material.

10. A clip as defined in claim 3, wherein the upper jaw includes a flattened surface, wherein the flattened surface of the upper jaw coincides with the flattened surface of the tail portion such that one continuous flattened surface is provided.

11. A clip described in claim 10, wherein said lens is freely laid on said one continuous flattened surface such that it overlays both the flattened surface of the jaw portion and the flattened surface of the tail portion.

12. A clip as described in claim 1, wherein said clip is manufactured from an acetal resin material.

* * * * *